United States Patent [19]

Richter

[11] Patent Number: 4,538,800

[45] Date of Patent: Sep. 3, 1985

[54] PRINTED COPY SEPARATING AND ROUTING MECHANISM

[75] Inventor: Johannes Richter, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 468,412

[22] Filed: Feb. 22, 1983

[30] Foreign Application Priority Data

Mar. 19, 1982 [DE] Fed. Rep. of Germany ..... 3210203

[51] Int. Cl.[3] ..... B65H 3/06

[52] U.S. Cl. ..... 271/120; 83/106; 198/781; 271/304; 474/49

[58] Field of Search ..... 271/303, 304, 279, 119, 271/120; 198/624, 790, 781; 474/47, 49, 95, 96; 83/102, 106

[56] References Cited

U.S. PATENT DOCUMENTS

| | | | |
|---|---|---|---|
| 3,206,191 | 0/1965 | Hantscho | 271/303 |
| 3,961,785 | 6/1976 | Gall | 271/119 |
| 4,373,713 | 2/1983 | Loebach | 271/303 |

*Primary Examiner*—George E. A. Halvosa
*Assistant Examiner*—John A. Carroll
*Attorney, Agent, or Firm*—Frishauf, Holtz, Goodman & Woodward

[57] ABSTRACT

To provide for deflection of copy between two respective paths (8, 16; 9, 17) without using switchable deflection tongues, two cylinders (3, 4) have segmental elements (24, 27) located thereon which are respectively, selectively, positionable on or within the circumference of the cylinders, or projecting therefrom, for example by securing the segmental elements in projected position, or by controllable eccenters (28–35). Copy is fed by a belt transport system between the cylinders and, if the copy meets a projecting segment, the projecting segment will deflect the copy into one of the paths, in accordance with the position of guide tongue structure (36). Alternate feed in the respective path can be obtained by offsetting the projecting segments (25, 27) from each other, for example by 90° (FIG. 3) and feeding copy with equal copy length and copy spaces therebetween to the cylinders, so that the copy will be directed, alternately, to one, or the other of the exit paths.

14 Claims, 5 Drawing Figures

PRINTED COPY SEPARATING AND ROUTING MECHANISM

The present invention relates to printing machinery in general, and more particularly to apparatus to separate printed copy, which may be one sheet, or an assembly of sheets, being fed continuously to the mechanism, and direct the respective sheets or sheet assemblies to one or two different paths.

BACKGROUND

Various types of routing or copy directing mechanisms are known. U.S. Pat. No. 3,206,191, for example, describes an apparatus in which a tape guide system is used through which printed copy, supplied from a gap between two cylinders or rollers, is transported. A tiltable flap or cam element is provided, which can rock in accordance with rocking movement of a rod, the cams forming deflection tongues and directing the printed copy into either an upper or a lower path. The deflecting tongues can be fixed either in the upper or lower position, or they can rock in synchronism with the received printed copy between the upper and lower positions. It is, thus, possible to direct the received copy either into an upper or into a lower further transport mechanism or, selectively, and alternately, feed the received copy into the respective upper and lower positions, as the deflection tongues are being rocked.

The system to split up a stream of printed copies, as described, is limited as far as operating speed is concerned since the moments of inertia of the movable mechanical elements do not permit extremely high operating speeds.

THE INVENTION

It is an object to provide an arrangement in which printed copy, which may be single sheets or an assembly of sheets, can be directed, selectively, into an upper or a lower transport path, and in which the sheets may be, alternately, directed to the upper or lower path without requiring mechanical switching of path directing elements.

Briefly, rollers are provided which have segmental elements located on the circumference thereof and positioned in the path of the printed copy which passes between rollers, the projecting segmental elements deflecting the printed copy into a first path or into a second path. Depending on the position of the segmental elements on the respective rollers, deflection of successively arriving printed copy, alternately, in the first or second path, can also be commanded. The circumferential position of the segments on the rollers and the rotary speeds of the cylinders with the deflecting segments are matched to the spacing of the arriving sheets to effect the respectively desired deflection into the respective paths. The projection or retraction of the segments, thus controlling the path of the copy, is controlled by eccentric positioning elements.

The system has the advantage that only continuously rotating elements are used, which do not require switching between deflecting switching positions; direction into the respective paths of the copy elements is commanded by synchronizing the passage of the respective copy between the cylinders carrying the segments with the respective segmental positions on the cylinders, which can be either preset by attaching the segments in predetermined positions, or which can be made changeable by projecting or retracting the segments, for example by means of a cam or eccenter.

DRAWINGS

DETAILED DESCRIPTION

Figure 1:
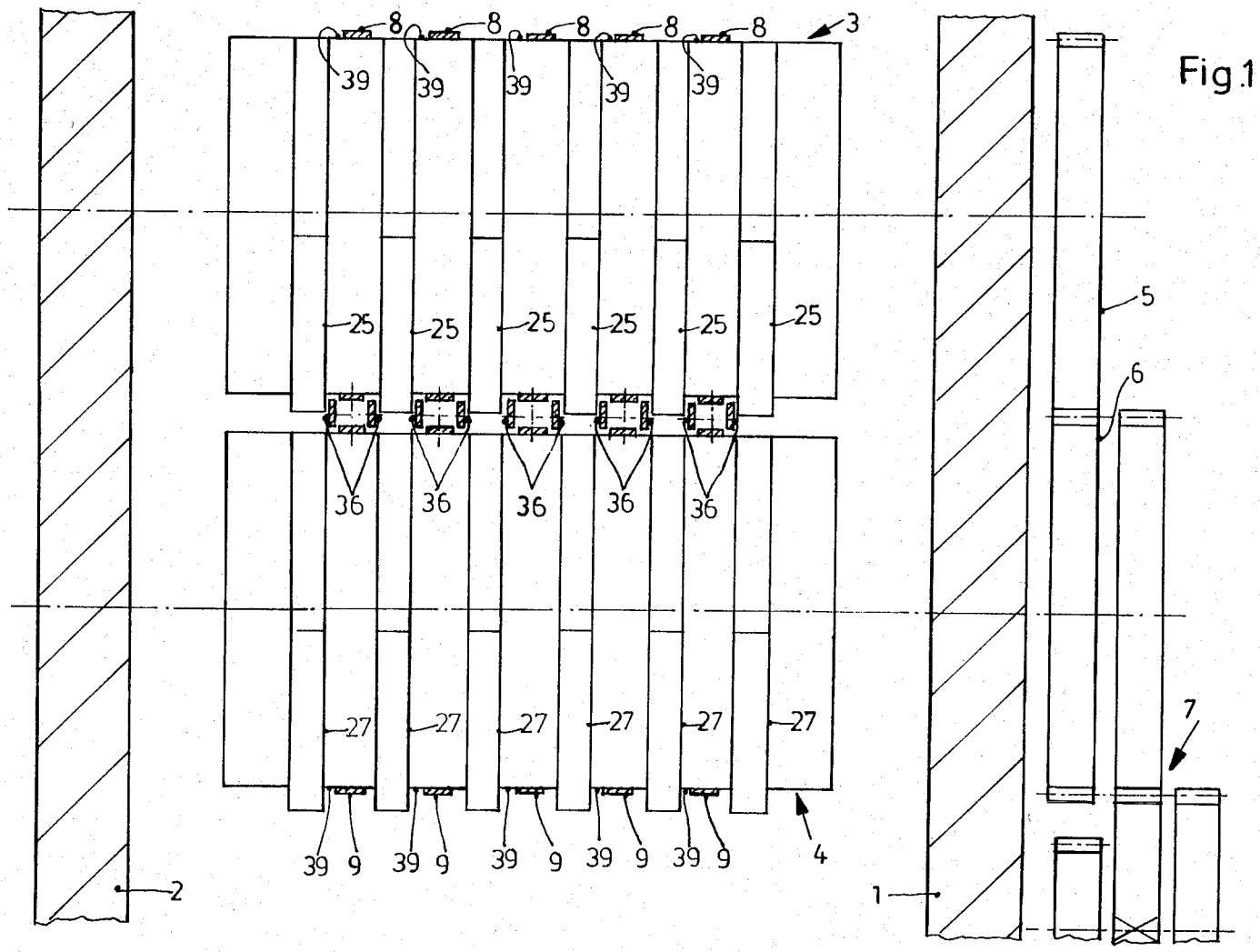
FIG. 1 is a schematic side view, partly in section, of the apparatus to separate a stream of copy for placement into respective paths.

Cylinders or rollers 3, 4 are journalled between side walls 1, 2 of the machine. The cylinders or rollers 3, 4 are driven by gears 5, 6 which, in turn, are driven by gearing 7, which is a reduction gearing, which can be clutched in and out of engagement with the gears 6, as desired, by a suitable clutch (not shown).

Figure 2:
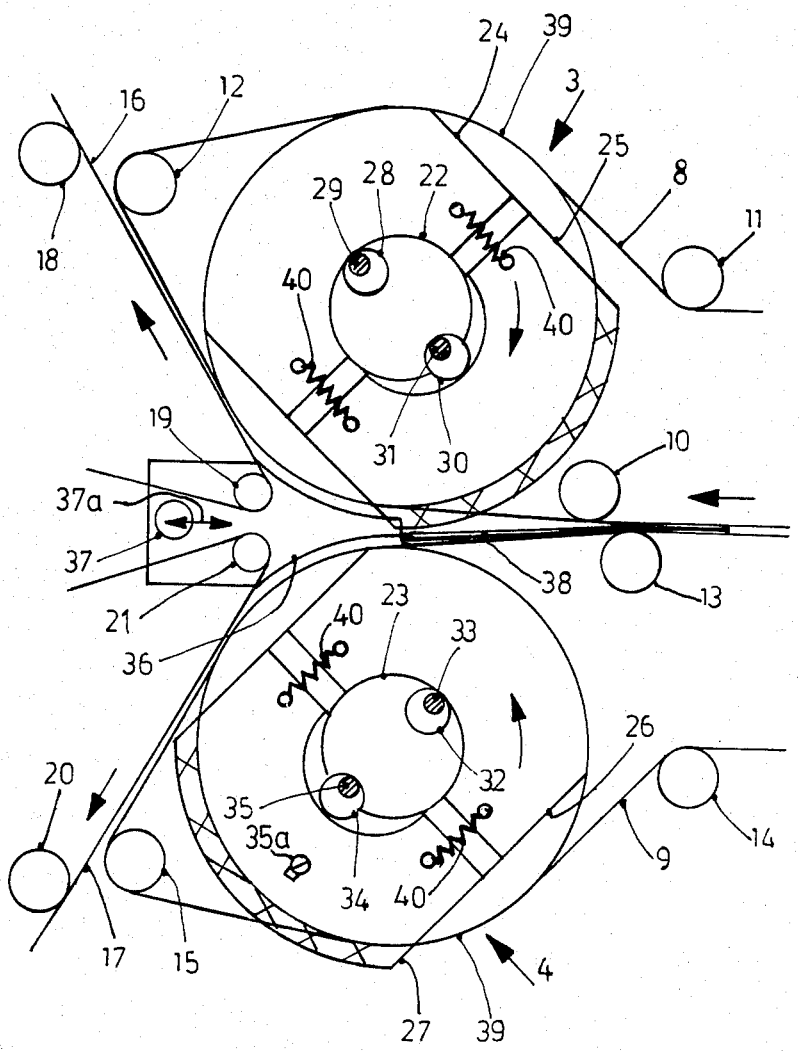
FIG. 2 is an end view of the structure of FIG. 1, omitting all elements not necessary for an understanding of the present invention.

A tape or belt transport system 8 (see also FIG. 2) is looped about the upper cylinder 3. A belt transport system 9 is looped about the lower cylinder 4. Additional guide rollers 10–15 are provided in order to guide the belts 8, 9—see FIG. 2. The adjacent portions of the belts 8, 9 form a supply transport path to the cylinders 3, 4. Behind the cylinders 3, 4—in the direction of rotation of the cylinders—the belts 8, 9 diverge and, together with further belts 16, 17 (FIG. 2) form divergent transport paths, one being directed upwardly and one downwardly, as seen in FIG. 2. The belts 16, 17 are guided by guide rollers 18–21, as customary and well known.

Cylinders 3, 4 are journalled on shafts 22, 23 (FIG. 2) in the side walls 1, 2 in any suitable and customary manner.

In accordance with the present invention, disk-shaped segments 24, 25, 26, 27 are secured to the respective cylinders 3, 4. The segments 24–27 can be selectively projected from the circumference of the cylinders 3, 4. Eccenters 28, 30 and 32, 34 are located on associated eccentric shafts 29, 31, 33 and 35, respectively positioned in recesses in shafts 22, 23. Upon rotation of the shafts, rotating the respective eccenters, the segments 24–27 are, selectively, projected from the circumference of the respective cylinders 3, 4, or retracted therefrom, or at least to match the circumference of the respective cylinders.

The eccentrics 28, 30, 32, 34 can be individually adjusted by rotating the respective eccentric shafts 29, 31, 33, 35 from the end face of the respective cylinders 3, 4, to thus individually control the position of the segments 24–27. Such rotation may be effected, for example, by a cam engaging projecting portions of the eccenter shaft. In many applications, it is preferred, however, not to adjust the position of the eccenters 24–27 by camming or other arrangements which are expensive and subject to wear but, rather, to place the respective segments in either retracted or projected position, and clamp the segments in the respectively adjusted position, for example by clamping screws or bolts passing into the respective cylinders 3, 4. Only one such bolt 35*a* is shown, the bolt clamping the respective segment 27 in a selected position, the segment 27 being formed with a suitable elongated opening to receive the bolt and permit sliding movement with respect thereto. By exchanging the respective segments, secured to the rollers or cylinders 3, 4, various operating modes are possible, as will be described in detail below.

A deflection guide tongue structure 36 is located behind the cylinders 3, 4. The structure 36 is secured in the side walls by a rod 37, permitting longitudinal adjustment as schematically illustrated by the arrow 37*a*. Rod 37 extends parallel to the axes of the cylinders 3, 4.

Basic Operation

Printed copy, which may be single sheets, stacks of sheets, or already assembled folded cut sheets, is guided between the transport belts 8, 9. Such copy 38 is passed between the cylinders 3, 4 and, in dependence on the angular position of the segments 25, 27, is gently introduced into the path above or below the deflection tongue structure 36 into the respective removal paths formed by the belts 9, 17 and 8, 16, respectively.

In accordance with a preferred structure, the segments 24–27 have an arcuate or circumferential length which is approximately as long as the copy 38 which is to be fed. In FIG. 2, only segments 25, 27 are illustrated as projecting from the circumference of the rollers or cylinders 3, 4, that is, projecting from a smooth cylindrical surface thereof. Upon rotation of the cylinders 3, 4, in synchronism with the supply system, for example in synchronism with a printing machine—not shown in the drawings—or a folding apparatus, likewise not shown, copy 38 fed by the belts 8, 9 will be directed, alternately, below the tongue of the path separating structure 36 and above the tongue of the separating structure 36. The projecting segment 25—see FIG. 2—will press the copy into the lower path, that is, beneath the tongue of guide structure 36, and between the belts 9, 17. Upon continued rotation of the rollers 3, 4, the next sheet will be engaged by the projecting segment 27 of roller 4, for deflection into the upper path of the tongue of the guide structure 36, that is, between belts 8 and 16. FIG. 2 clearly shows that the segments 25, 27 are so curved that the curvature matches the inlet to the respective transport path, and beneath the tongue of the deflection structure 36. Thus, the respective copy is gently introduced and guided, without requiring any mechanical switching during operation. Deflection of the respective copy 38 is effected only by respective engagement of projecting or nonprojecting segments on the rotating rollers 3, 4 with the copy 38. The radii of curvature of the segments and of the deflection tongue of the deflection element 36 are matched for smooth passage of the copy.

Segments 24–27 are suitably guided and positioned in the rollers 3, 4 by guide tracks or pins fitting, for example, into matching slots, and providing interengaging guide paths for the segments on the cylinders.

Figure 3:
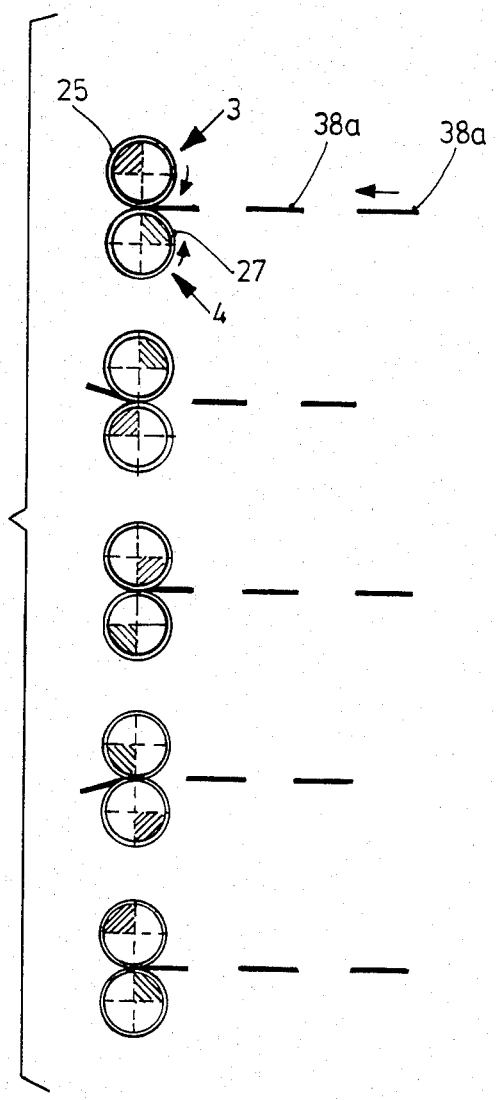
FIGS. 3 to 5 illustrate, schematically, various arrangements of segments, associated with copy elements for various modes of operation.
Figure 4:
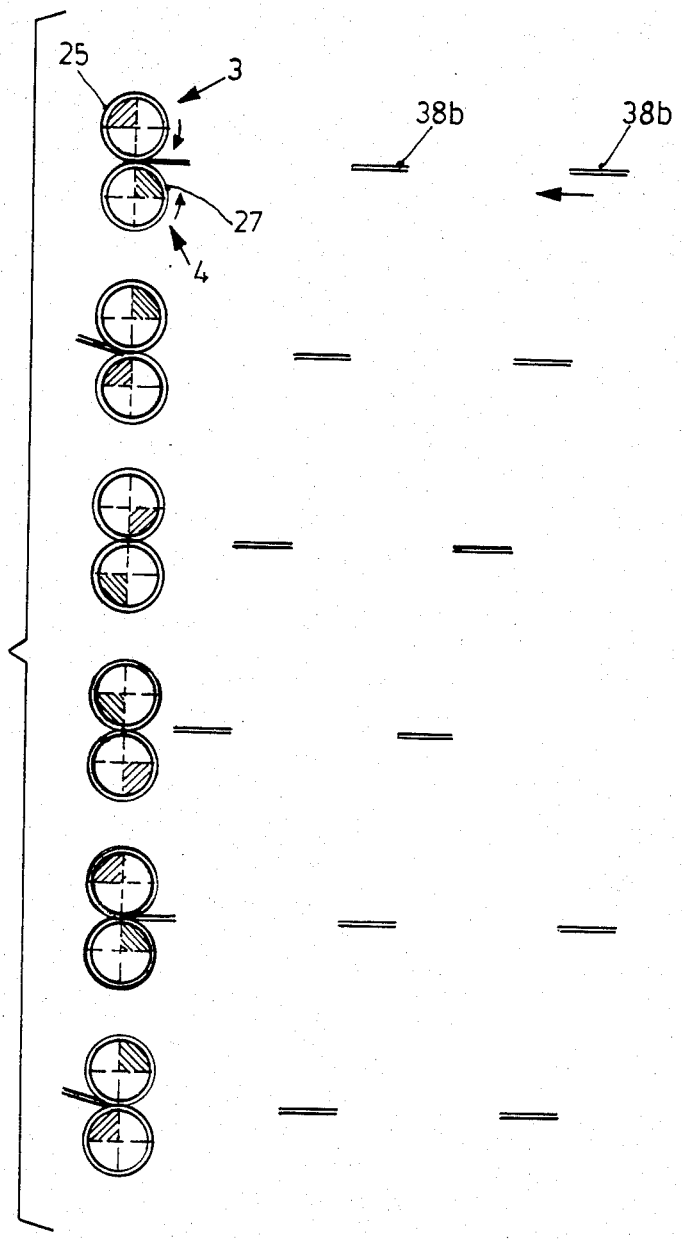
Figure 5:
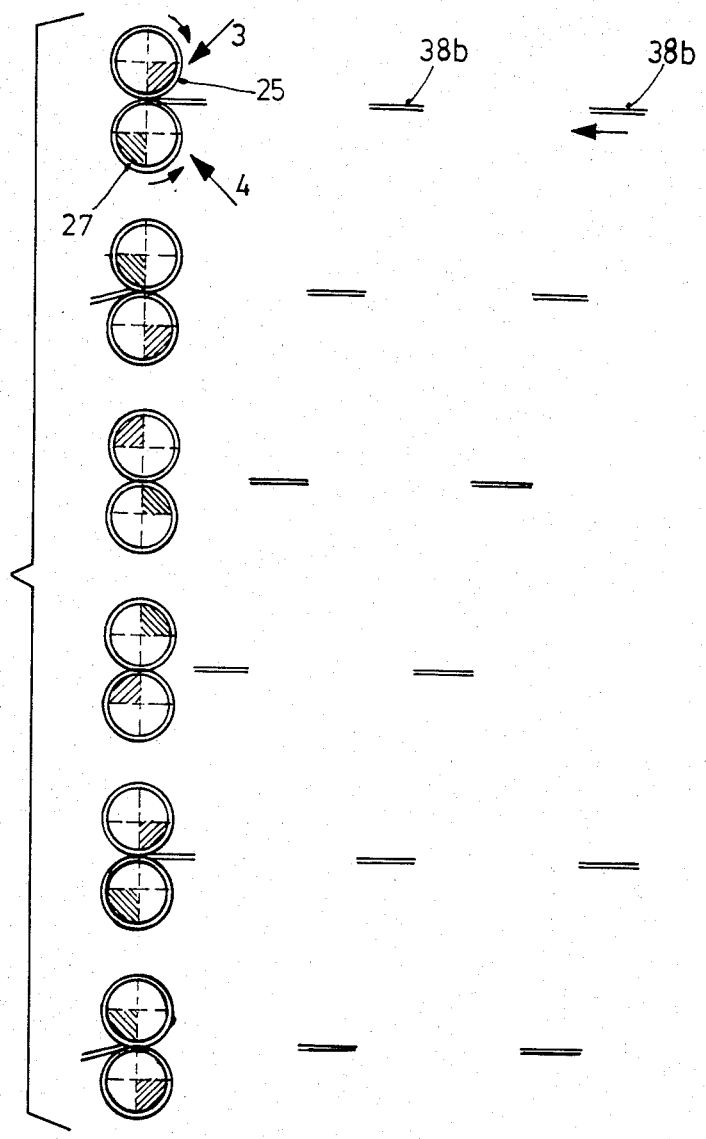

Description of Various Possibilities of Operating Modes, with reference to FIGS. 3–5

FIGS. 3–5 are schematic representations which illustrate respective production modes. In the Figures, the hatched quadrants represent segments which are projected from the circumference of the respective rollers 3, 4. The sequential representations show various rotary positions of the respective rollers or cylinders 3, 4, thus—collectively—illustrating the sequence of operation.

FIG. 3: This illustration shows a sheet 38, which has been folded in a folding cylinder, with a folding knife—not shown—in an earlier production step. The copy 38 is supplied in sequential, folded sheets, with a gap or space between the sheets, the gaps or spaces between the copy 38 corresponding to the length of the folded copy 38.

As seen in FIG. 3, the segments 25, 27, projecting from the respective cylinders 3, 4, are relatively shifted with respect to each other by 90°. Thus, the production stream is split into alternately upwardly directed and downwardly directed paths. Copy which, in the sequence illustrated in FIG. 3, is odd-numbered, is directed into the upper transport path; copy which is even-numbered, is directed into the lower transport path.

FIG. 4: Two sheets or copy elements 38 have been placed above each other, to form a gap between sequentially fed copy, which thus form an assembly of sheets 38*b* of one copy length. In accordance with the operation of FIG. 4, all sheets are directed into the upper transport path between belts 8, 16.

FIG. 5: The assembly or collection transport arrangement of FIG. 4 is modified by changing the respective times of arrival of the copy 38*b* at the cylinders which have the projecting segments. Thus, in the system of FIG. 5, all sheet assemblies 38*b* are directed to the lower transport path between belts 9, 17.

The eccentrics can be fixed in position, or selectively moved in and out of the cylindrical circumference of the rollers 4, 5. Clamping the segments in position has the advantage of simplicity. If the segments are clamped in position, the arrangement is preferably so made that the cylinders 3, 4 are mirror-symmetrical with respect to each other, so that segments which project from the circumference of the cylinder 3 or 4 can be removed, and inserted, in similar manner, diametrically opposite thereto. Such an arrangement is substantially less expensive than using the eccentric positioning system, and the eccentrics, together with their possible operating mechanism, can then be omitted entirely. The saving in costs does, however, decrease flexibility in operation.

By utilizing a suitable gearing 7, to drive the cylinders 3, 4 at selected speeds with respect to arrival of the sheets—compare FIGS. 3, 4 and 5—various types of operating modes are possible.

The segments 24, 25 on the cylinder 3, or 26, 27 on the cylinder 4, if not clamped by suitable screws, are preferably maintained in position by springs 40 which pull the segments towards each other, counter the projecting force of the respective eccenters 28, 30, 32, 34.

The belts 8, 9 are guided about the cylinders by belt rollers 39, rotatable on the shafts 22, 23 in order to compensate for different circumferential speeds between the belts 8, 9 and the respective rollers 3, 4.

Various changes and modifications may be made within the scope of the inventive concept.

I claim:

1. Printed copy separating and routing mechanism having a pair of rotating cylinders (3, 4);

means (10–15) feeding copy elements (38) to the cylinders;

receiving means (36) defining two alternate receiving paths into which the copy is selectively guided, or alternate copy elements are alternately guided, comprising a segmental element (25, 27) located on the circumference of each of the cylinders (3, 4) and positioned in the path of the copy which passes between the cylinders, to deflect the copy into the first path, or the second path, or, alternately, copy elements into the first and second paths, respectively, the position of the segments and the rotary speed of the cylinders (3, 4) being matched to the spacing of the arriving copy to effect such deflection into the respective paths;

and means for controlling the position of the segmental elements in relation to the circumference of the respective cylinder comprising eccentric positioning means (28–31; 32–35) selectively projecting respective segmental elements out of the circumference of the respective cylinder, or retracting the respective segmental elements to a non-projecting position from a cylindrical circumference defined by said cylinders (3, 4) whereby, upon projection of the respective elements, the segments will be placed into the path of transport of the copy (38) and deflect the transport path of the copy from a tangential path between the cylinders to a selected one of said first or second paths.

2. Mechanism according to claim 1, wherein the cylinders (3, 4) include axes of rotation;

and a plurality of segments (25, 27) are located on the respective axes to rotate therewith;

the means for feeding the copy includes web or belt guide elements (8, 9) and freely rotatable guide rollers (39) secured on the axes.

3. Mechanism according to claim 2, further including sheet removal transport belt means (16, 17).

4. Mechanism according to claim 2, wherein the plurality of segments includes a first row of segments (25, 27) located on the respective cylinders, and a second row of segments (24, 26) located on said cylinders diametrically opposite the segments of the first row.

5. Mechanism according to claim 1, wherein the segmental elements are selectively attachable and removable from the respective cylinder (3, 4).

6. Mechanism according to claim 1, wherein the eccentric positioning means comprises positioning rods (29, 31, 33, 35) extending parallel to the axes (22, 23) of the cylinders (3, 4);

and eccentric elements (28, 30, 32, 34) located on said positioning rods, the segmental elements (24–27) being formed with openings into which said eccentric elements engage for selectively pushing the eccentric elements out of the circumference of the respective cylinder, or retracting the eccentric elements to at least match the circumference of the respective cylinder.

7. Mechanism according to claim 1, further including a variable transmission drive gearing (7) coupled to the cylinders (3, 4) to drive the cylinders with selectively different speeds.

8. Mechanism according to claim 1, wherein the receiving means (36) defining two alternate receiving paths comprises a deflection structure (36) including deflection tongues defining a portion of the deflection paths;

and means (37, 37*a*) adjustably—with respect to said cylinders (3, 4)—positioning the deflection tongues.

9. Mechanism according to claim 1, wherein the copy feeding means comprises supply transport belt means (8, 9) looped, in part, about the respective cylinders and guided for feeding copy between the supply transport belt means, the supply transport belt means, after passing between the cylinders, being guided into divergent paths;

and additional removal belts (16, 17) engaging the diverging portions of the supply transport belt means for removal of the copy in the respectively commanded paths.

10. Mechanism according to claim 1, wherein the segmental elements (25) on one of the cylinders (3), and projecting from the circumference thereof, are angularly offset with respect to the segmental elements (26) which project from the other cylinder (4) for alternate guidance of received copy (38) into the first path and then into the second path.

11. Mechanism according to claim 1, wherein the segmental elements (25) which project from the circumference of one of the cylinders (3) are angularly offset with respect to the segmental elements (27) which project from the other cylinder (4) by 90°;

and wherein the copy feed means feed copy to the region between the cylinders at a spacing which is so matched to the speed and angular extent of the segmental elements that all copy elements (38) are guided into a selected one of said paths (FIG. 4: 8, 16; FIG. 5: 9, 17).

12. Mechanism according to claim 11, wherein the segmental elements (25, 27) which project from the circumference of the respective cylinders (3, 4) are shiftable by 180° for changing feed of respective copy from one selected path (FIG. 4: 8, 16) to the other selected path (FIG. 5: 9, 17).

13. Mechanism according to claim 1, wherein the cylinders (3, 4) comprise a plurality of disk-shaped elements of, essentially, cylindrical circumference, and the segmental elements (24–27) are located between the respective disk-shaped elements thereof.

14. Mechanism according to claim 1, wherein each one of the cylinders includes paired segmental elements (24, 25; 26, 27), the segmental elements of the pairs being located diametrically opposite each other on the respective cylinders.

* * * * *